US008814729B2

(12) United States Patent
Hartigan

(10) Patent No.: US 8,814,729 B2
(45) Date of Patent: Aug. 26, 2014

(54) TACKLE PRACTICE APPARATUS AND A METHOD FOR PRACTISING TACKLING IN A CONTACT SPORT

(76) Inventor: John Paul Hartigan, Limerick (IE)

( * ) Notice: Subject to any disclaimer, the term of this patent is extended or adjusted under 35 U.S.C. 154(b) by 112 days.

(21) Appl. No.: 13/265,578

(22) PCT Filed: Apr. 22, 2010

(86) PCT No.: PCT/IE2010/000025

§ 371 (c)(1),
(2), (4) Date: Dec. 6, 2011

(87) PCT Pub. No.: WO2010/122540

PCT Pub. Date: Oct. 28, 2010

(65) Prior Publication Data

US 2012/0094788 A1 Apr. 19, 2012

(30) Foreign Application Priority Data

Apr. 22, 2009 (IE) ..... S2009/0316

(51) Int. Cl.
*A63B 69/34* (2006.01)

(52) U.S. Cl.
USPC ..... 473/445; 473/441; 473/422; 273/DIG. 30

(58) Field of Classification Search
USPC ..... 473/446, 445, 439, 422, 441, 444, 443; 482/105, 90, 93–95, 128, 88
See application file for complete search history.

(56) References Cited

U.S. PATENT DOCUMENTS

| | | | | | |
|---|---|---|---|---|---|
| 396,938 | A | * | 1/1889 | Kemmler | 73/379.05 |
| 419,285 | A | * | 1/1890 | Sanborn | 482/90 |
| 1,544,110 | A | * | 6/1925 | Stall | 473/444 |
| 1,622,691 | A | * | 3/1927 | Warner | 473/442 |
| 1,906,693 | A | * | 5/1933 | Loughlin | 473/442 |
| 2,237,599 | A | * | 4/1941 | Gilman | 473/444 |
| 2,612,924 | A | * | 10/1952 | Cunningham | 383/3 |
| 3,234,685 | A | * | 2/1966 | Harrowe | 446/177 |

(Continued)

FOREIGN PATENT DOCUMENTS

| | | | | |
|---|---|---|---|---|
| GB | 2027349 A | * | 2/1980 | A63H 30/04 |
| GB | 2 308 074 A | | 6/1997 | |
| GB | 2 371 756 A | | 8/2002 | |
| JP | 09122357 A | * | 5/1997 | A63H 3/06 |

*Primary Examiner* — Mitra Aryanpour

(74) *Attorney, Agent, or Firm* — Tutunjian & Bitetto, P.C.

(57) ABSTRACT

Tackle practice apparatus (1) comprises an inflatable dummy element (3) in the shape of a person, and is releasably coupled to an inflatable ground engaging sled (4) from which a rope (5) extends to a harness (6) which is releasably coupleable to a person for pulling the tackle practice apparatus across a playing pitch for tackle practice by a player. The dummy element (3) comprises a base element (9) and an inflatable central bladder (7) extending upwardly from the base element (9). Two inflatable lower peripheral bladders (10) and two inflatable upper peripheral bladders (13) extend around the central bladder (7). The lower peripheral bladders (10) are located below a waist high position (14). The base element (9) comprises an inflatable first base bladder (15) which is inflatable with water to provide ballast to the dummy element (3), and an inflatable second base bladder (16) above the first base bladder (15) from which the central bladder (7) extends. On the dummy element (3) being correctly tackled below the waist high position (14) by a player, air from the central bladder (7) is expelled through a whistle (31), thus indicating a correct tackle. The sled (4) comprises an inflatable ring (21).

15 Claims, 7 Drawing Sheets

(56) References Cited

U.S. PATENT DOCUMENTS

Figure 1:
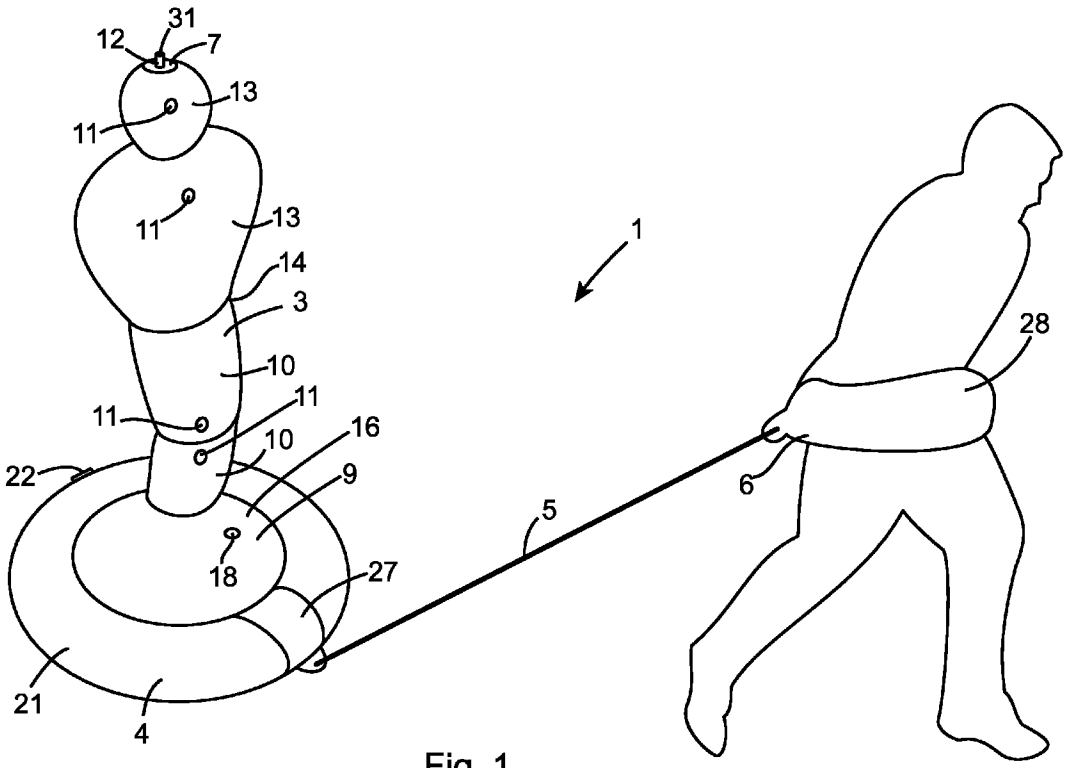

| | | | | |
|---|---|---|---|---|
| 3,379,441 | A * | 4/1968 | Feather et al. | 473/570 |
| 3,519,269 | A * | 7/1970 | Howlett et al. | 482/120 |
| 3,659,848 | A | 5/1972 | DePew | |
| 3,972,238 | A * | 8/1976 | Thatcher | 482/128 |
| 5,232,390 | A * | 8/1993 | Brooks | 473/476 |
| 5,335,906 | A | 8/1994 | Delker | |
| 6,319,157 | B1 * | 11/2001 | Broadbent | 473/446 |
| 6,612,971 | B1 * | 9/2003 | Morris | 482/74 |
| 7,322,905 | B2 * | 1/2008 | Morris | 482/74 |
| 7,416,412 | B2 * | 8/2008 | Segrest et al. | 434/226 |
| 7,727,089 | B2 * | 6/2010 | Gilman | 473/445 |
| 7,972,224 | B2 * | 7/2011 | Gilman | 473/455 |
| 8,109,863 | B2 * | 2/2012 | Gilberti et al. | 482/105 |
| 2005/0192165 | A1 | 9/2005 | Booker | |
| 2007/0254790 | A1 | 11/2007 | Adams | |
| 2010/0035724 | A1 * | 2/2010 | Ungari et al. | 482/4 |
| 2010/0062881 | A1 * | 3/2010 | Horkan | 473/439 |
| 2012/0094788 | A1 * | 4/2012 | Hartigan | 473/445 |

* cited by examiner

TACKLE PRACTICE APPARATUS AND A METHOD FOR PRACTISING TACKLING IN A CONTACT SPORT

The present invention relates to tackle practice apparatus, and in particular, to tackle practice apparatus for use in training for contact sports, for example, in rugby practice training. The invention also relates to a method for practising tackling in a contact sport, for example, practising tackling during rugby practice training. The invention also relates to a sled for use in running and sprinting training and to a method for training a person to run or sprint.

The ability to tackle a player in an opposing team in a contact sport is important in many contact sports. For example, in the game of rugby, a good tackle on a player of an opposing team can make the difference between winning and losing a game. It is therefore important that players in such contact sports in which tackling a player on an opposing team is an important part of the sport are well trained in carrying out such tackles. In general, practising tackling is carried out using human persons as a target to be tackled. The human person acting as the tackle target, depending on the type of tackling being practised, may run towards a player, away from the player or across the path of the player. The player then tackles the human tackle target. This is undesirable, since the tackle target, being a human, can be injured in such tackle practices. Additionally, the player making the tackle may also be injured. There is therefore a need for apparatus which addresses this problem.

The present invention is directed towards providing tackle practice apparatus, and the invention is also directed towards providing a method for practising tackling in a contact sport. The invention is also directed towards providing a sled for use in running or sprinting training, and to a method for training a person to run or sprint.

According to the invention there is provided tackle practice apparatus comprising a dummy element adapted to be tackled, and a connecting means for releaseably connecting the dummy element to a motive means for pulling the dummy element over a play area to simulate a player moving over the play area.

Preferably, the dummy element comprises an elongated element adapted to extend in a generally upright orientation in use. Advantageously, the dummy element is adapted to be inflatable. Ideally, the dummy element comprises an elongated inflatable central bladder extending longitudinally upwardly through the dummy element.

In one embodiment of the invention the central bladder is of circular transverse cross-section.

In another embodiment of the invention the central bladder extends substantially the length of the dummy element.

Preferably, at least one inflatable peripheral bladder extends around the central bladder. Advantageously, a plurality of the peripheral bladders extend around the central bladder. Ideally, adjacent ones of the peripheral bladders abut each other. Preferably, each peripheral bladder extends completely around the central bladder. Advantageously, each peripheral bladder defines an annulus.

Preferably, the peripheral bladders are inflatable independently of each other. Advantageously, each peripheral bladder is inflatable independently of the central bladder.

In one embodiment of the invention the peripheral bladder or the peripheral bladders are located on the central bladder from a position approximately waist high downwardly along the central bladder. Preferably, the peripheral bladders substantially represent a human subject from the waist downwards.

In another embodiment of the invention one of the central bladder and at least one of the peripheral bladders is configured so that when the dummy element is subjected to a correct tackle, an indicating means is activated to indicate that the tackle on the dummy element is a correct tackle. Preferably, the indicating means comprises a whistle which is activated by air being expelled from one of the central bladder and the peripheral bladder in response to a correct tackle.

In another embodiment of the invention the whistle is responsive to air being expelled from the central bladder.

In a further embodiment of the invention the whistle is responsive to air being expelled from the peripheral bladder.

Preferably, the whistle communicates with the one of the central bladder and the peripheral bladder to which it is responsive. Advantageously, the whistle communicates with the one of the central bladder and the peripheral bladder, to which it is responsive, through a high pressure relief valve.

In another embodiment of the invention an upper bladder is provided above the peripheral bladder or the peripheral bladders, the upper bladder substantially representing the upper torso of a human subject. Preferably, the upper bladder substantially represents the head of a human subject.

In another embodiment of the invention a pair of upper bladders are provided, one of which upper bladders represents the upper torso of a human subject and the other of which represents the head of a human subject.

In a further embodiment of the invention the central bladder extends through each upper bladder. Preferably, the central bladder extends substantially centrally through each upper bladder. Advantageously, each upper bladder defines an annulus extending around the central bladder. Preferably, the upper bladders are inflatable independently of each other. Advantageously, each upper bladder is inflatable independently of the central bladder. Ideally, each upper bladder is adapted to be inflated with air.

In an alternative embodiment of the invention the central bladder extends upwardly to the waist high position and terminates at the waist high position.

In another embodiment of the invention the dummy element comprises a base element. Preferably, the central bladder extends upwardly from the base element.

In one embodiment of the invention the base element is adapted to be weighted in order to provide the dummy element with a relatively low centre of gravity.

In another embodiment of the invention the base element comprises an inflatable first base bladder. Advantageously, the first base bladder is adapted to be inflatable with a liquid.

In another embodiment of the invention the base element comprises a second inflatable base bladder located above the first base bladder. Preferably, the second base bladder is adapted to be inflated with air.

Preferably, each peripheral bladder is adapted to be inflated with air. Advantageously, the central bladder is adapted to be inflated with air.

In one embodiment of the invention the connecting means comprises a ground engaging sled, and the dummy element is adapted for coupling to the sled. Preferably, the dummy element is adapted to be releaseably coupled to the sled. Advantageously, the dummy element is coupleable to the sled by a coupling means. Ideally, the coupling means comprises a releasable coupling means.

In one embodiment of the invention the coupling means comprises hooks and eyes.

In another embodiment of the invention the sled comprises an inflatable ground engaging bladder. Preferably, the ground engaging bladder of the sled defines an annulus. Preferably, the ground engaging bladder is adapted to be inflated with air.

Advantageously, a ligature is coupled to the sled and extends therefrom for coupling the sled to the motive means. Ideally, the ligature comprises a rope. Preferably, the ligature terminates in a harness for coupling to the motive means. Preferably, the harness is adapted for releasably coupling to the motive means. Advantageously, the harness is adapted for coupling to a human person.

The invention also provides a method for practicing tackling in a contact sport, the method comprising providing a dummy element adapted to be tackled, and releaseably coupling the dummy element to a motive means, pulling the dummy element over a playing area by the motive means, and tackling the dummy element while the dummy element is being pulled over the playing area.

Preferably, the method further comprises providing tackle practice apparatus according to the invention, and the dummy element is the dummy element of the tackle practice apparatus.

Advantageously, the connecting means connects the dummy element to the motive means provided by a human person.

The invention also provides a sled comprising an inflatable ground engaging element defining a hollow interior region for receiving a ballast medium, and a connecting means for connecting the sled to a person for pulling thereof.

Preferably, the hollow interior region is adapted for receiving a liquid ballast medium. Advantageously, the hollow interior region is adapted for receiving water as the ballast medium.

In one embodiment of the invention the hollow interior region defines a first chamber for receiving the ballast medium, and a second chamber for receiving an inflating medium. Preferably, the second chamber is located above the first chamber.

In another embodiment of the invention the inflatable ground engaging element is in the form of a torus defining an annular hollow interior region.

Preferably, an indicating means is provided for indicating the amount of ballast medium in the hollow interior region. Advantageously, the indicating means for indicating the amount of ballast medium in the hollow interior region comprises a gauge. Ideally, the gauge comprises a transparent window formed in the inflatable ground engaging element having graduations provided thereon.

In one embodiment of the invention the connecting means comprises a ligature extending from the ground engaging element. Preferably, the connecting means comprises a harness for coupling to the person. Advantageously, the harness is connected to the ground engaging element by the ligature. Ideally, the harness is adapted for securing to the waist of a person.

In one embodiment of the invention the sled is adapted for use in training a person to run.

In a further embodiment of the invention the sled is adapted for use in training a person to sprint.

Further the invention provides a method for training a person to run comprising attaching the sled according to the invention to the person by the connecting means with the ground engaging element inflated with at least a ballast medium and letting the person run with the sled trailing behind the person and with the ground engaging element engaging the ground.

In one embodiment of the invention the ballast medium in the hollow interior region is selectively adjusted between periods of training.

In another embodiment of the invention the method is adapted for training a person to sprint.

The advantages of the invention are many. The provision of the tackle practice apparatus avoids the need for a human person to act as a tackle target, and thereby, injury to such human tackle targets no longer arises. A further advantage of the invention is that by virtue of the fact that the tackle practice apparatus comprises a dummy element, the risk of injury to a person practising tackling is also reduced. By providing a connecting means for releasably connecting the dummy element to a motive means, there is a relatively low risk of injury to the player making the tackle, due to the fact that, in general, on being tackled the dummy element detaches from the connecting means or the motive means. Additionally, by virtue of the fact that the dummy element detaches from the connecting means or the motive element, when the motive means is a human person, no danger to the person acting as the motive means during tackling of the dummy element, since the dummy element on being tackled detaches from the human person.

By providing the dummy element as an inflatable element further minimises the risk of injury to a person practising tackling, since the inflated dummy element is resilient and thus minimises risk of injury to the person practising tackling. By providing an indicating means to indicate a correct tackle has the further advantage that a player is made aware immediately on tackling as to whether the tackle has been a correct tackle or otherwise.

A further advantage of the invention is that by providing the dummy element and the sled to be inflatable elements, the apparatus may be stored in a deflated state where it would take up relatively little space, and could be inflated with air and water as appropriate when required.

A particularly important advantage of the invention is that it provides a moving dummy element for tackle practice, as opposed to a static practice device of the types known heretofore. The tackle practice apparatus according to the invention allows practising in a much more realistic manner since the dummy element on being trailed across a pitch is a moving element, and thus essentially simulates an actual situation which would be presented to a player during a game, such as a game of rugby. By providing the dummy element in the shape of a human person, the tackle practice device according to the invention further enhances the authenticity of the device. A further advantage of the invention is achieved by providing the dummy element in the shape of a person in a slightly bent knee posture, since this assists a player in knowing precisely where to place his or her head relative to the dummy element during tackle practice.

The advantage of providing the sled for use in the training of a person to run or sprint are many. By virtue of the fact that the sled comprises an inflatable ground engaging element, the sled when not in use can be deflated and folded for storage.

The sled can then be re-inflated with a ballast medium and/or air.

The provision of the ground engaging element with a hollow interior region which is divided into first and second chambers facilitates independent charging of the hollow interior region with the ballast medium and air. The fact that the ground engaging element is adapted for charging with a liquid ballast medium, for example, water, facilitates altering the volume, and in turn the weight of ballast medium in the ground engaging element, so that during a training session, or between training sessions, or where the sled is to be used for training different individuals, the amount of ballast medium in the ground engaging element can be readily altered.

Figure 2:
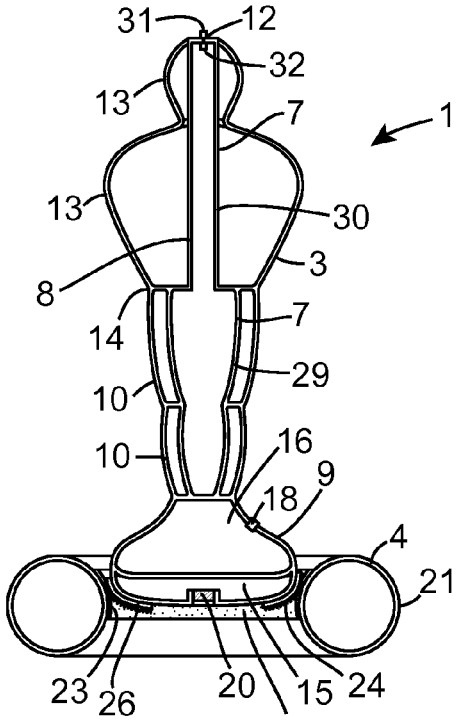
Figure 3:
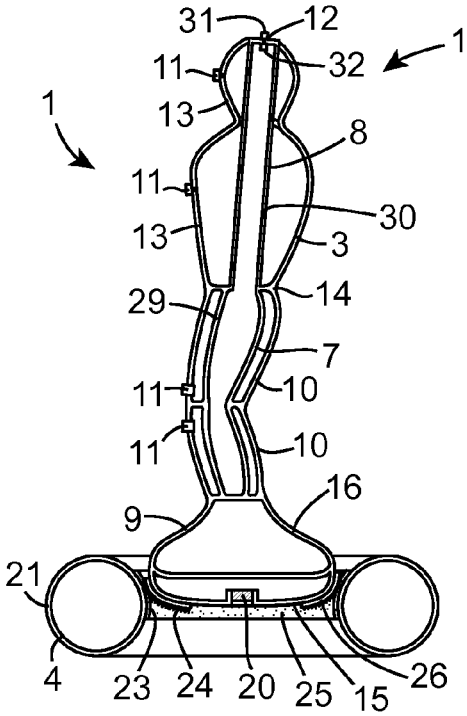
Figure 7:
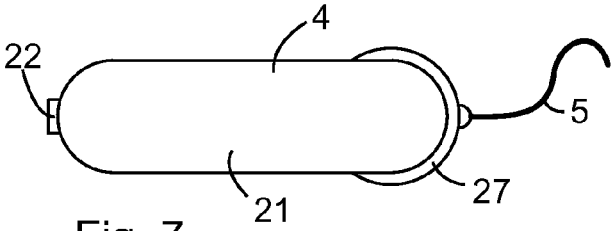
Figure 6:
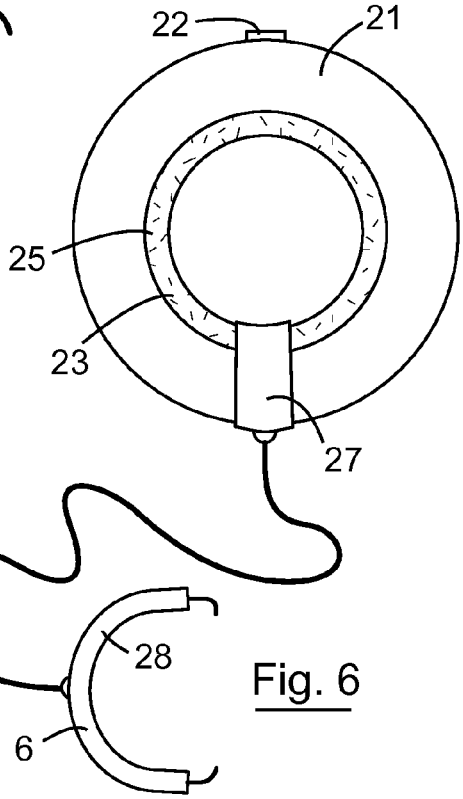
Figure 8:
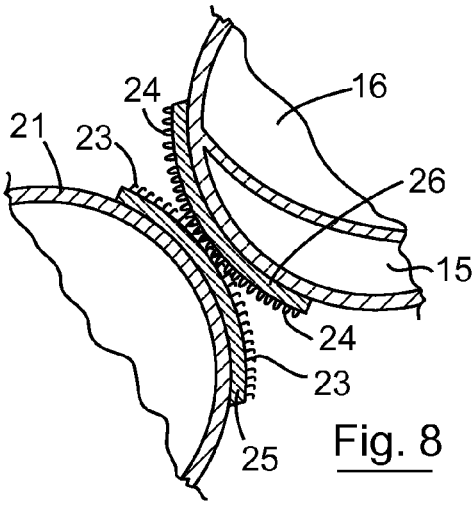
Figure 4:
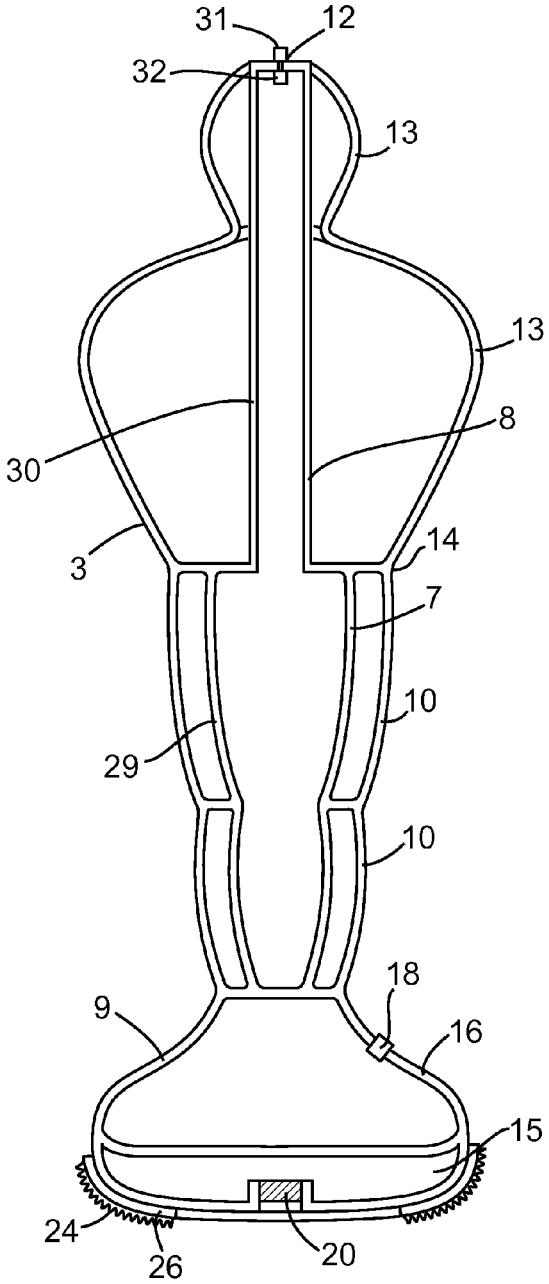
Figure 5:
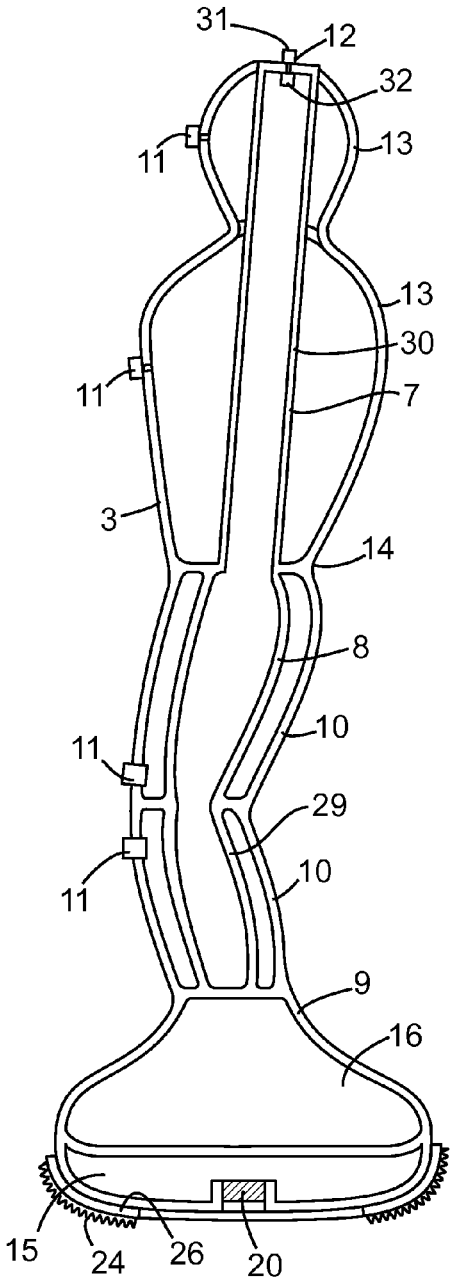
Figure 10:
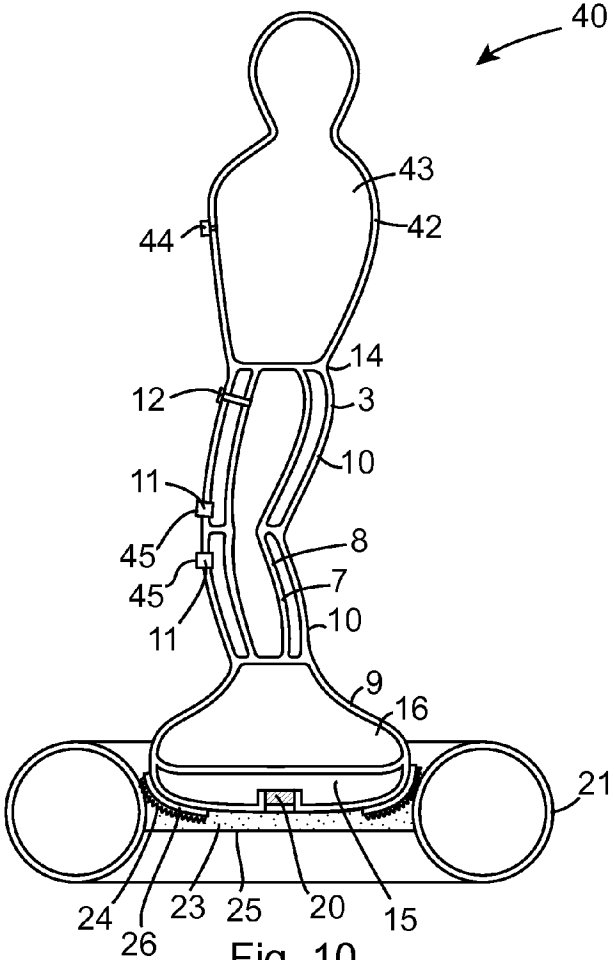
Figure 9:
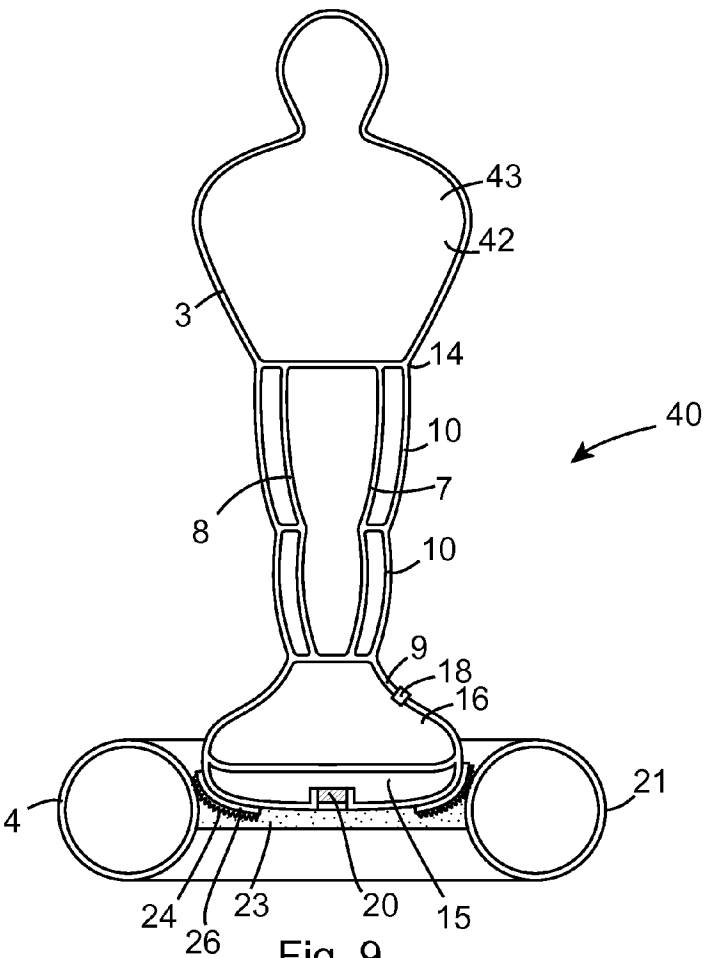
Figure 11:
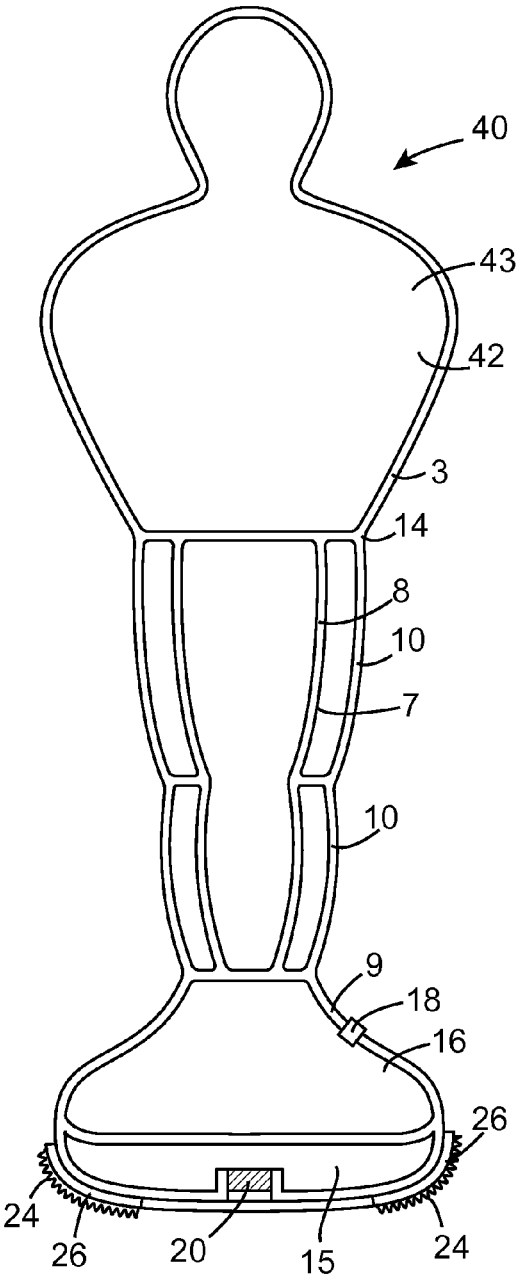
Figure 12:
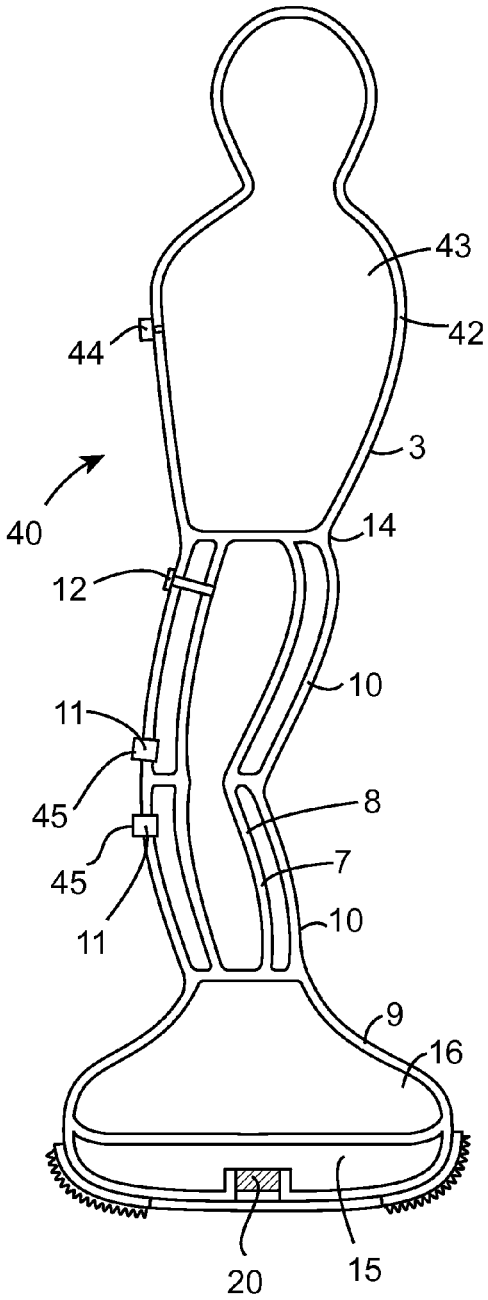
Figure 13:
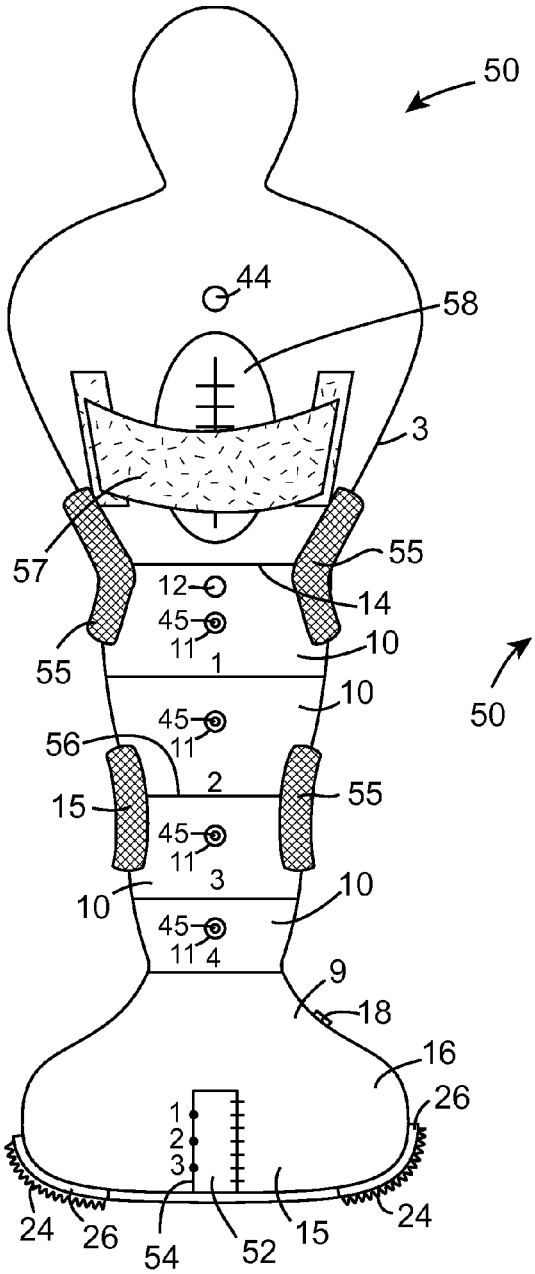
Figure 14:
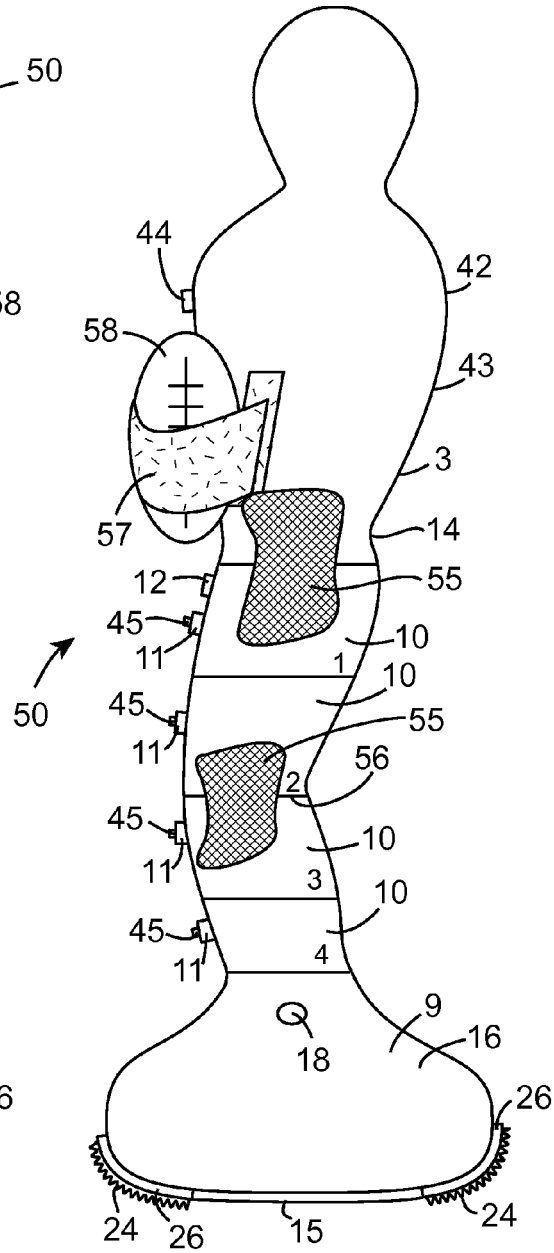
Figure 15:
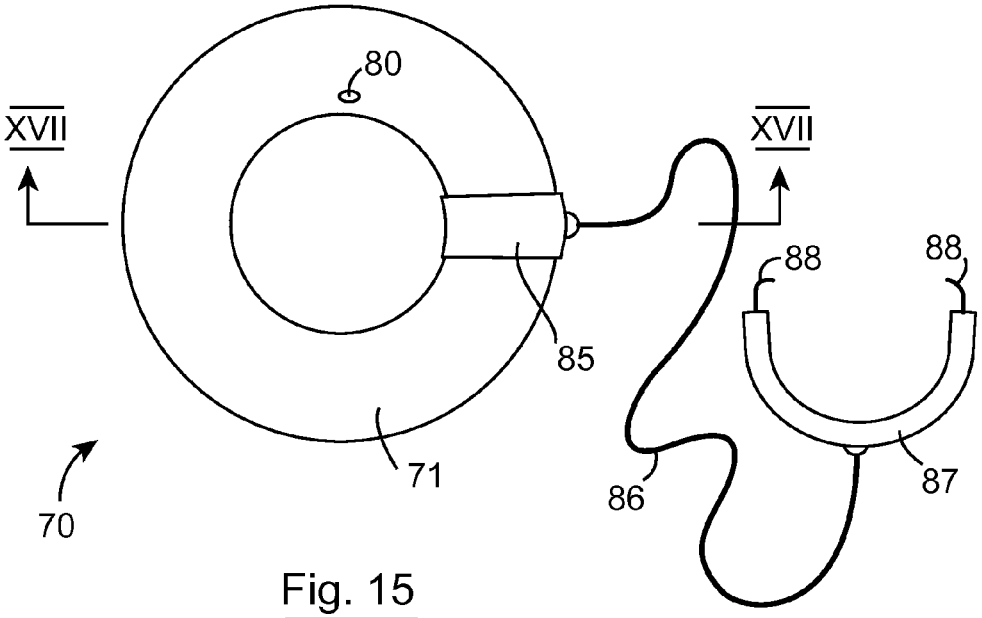
Figure 16:
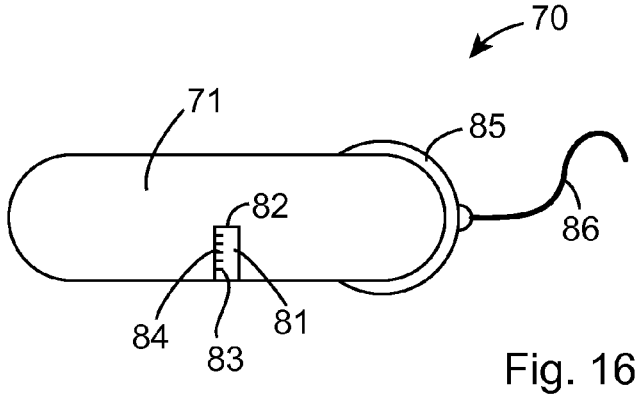
Figure 17:
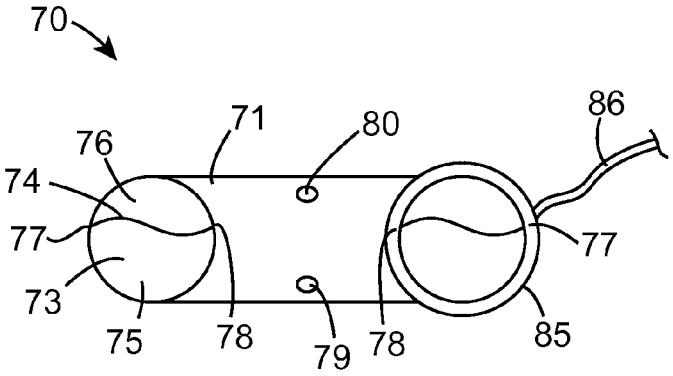

The invention will be more clearly understood from the following description of some preferred embodiments thereof which are given by way of example only, with reference to the accompanying drawings, in which:

FIG. 1 is a perspective view of a tackle practice apparatus according to the invention, in use, FIG. 2 is a cross-sectional front elevational view of the tackle practice apparatus of FIG. 1, FIG. 3 is a cross-sectional side elevational view of the tackle practice apparatus of FIG. 1, FIG. 4 is a cross-sectional front elevational view of a part of the tackle practice apparatus of FIG. 1, FIG. 5 is a cross-sectional side elevational view of the part of FIG. 4 of the tackle practice apparatus of FIG. 1, FIG. 6 is a top plan view of another part of the tackle practice apparatus of FIG. 1, FIG. 7 is a side elevational view of a portion of the part of FIG. 6 of the tackle practice apparatus of FIG. 1, FIG. 8 is an enlarged cross-sectional view of a detail of the tackle practice apparatus of FIG. 1, FIG. 9 is a cross-sectional front elevational view of tackle practice apparatus according to another embodiment of the invention, FIG. 10 is a cross-sectional side elevational view of the tackle practice apparatus of FIG. 9, FIG. 11 is a cross-sectional front elevational view of a part of the tackle practice apparatus of FIG. 9, FIG. 12 is a cross-sectional side elevational view of the part of FIG. 11 of the tackle practice apparatus of FIG. 9, FIG. 13 is a front elevational view of a part of tackle practice apparatus according to another embodiment of the invention, FIG. 14 is a side elevational view of the part of FIG. 13 of the tackle practice apparatus of FIG. 13, FIG. 15 is a top plan view of a sled according to the invention, FIG. 16 is a side elevational view of the sled of FIG. 15, and FIG. 17 is a cross-sectional side elevational view of the sled of FIG. 15 on the line XVII-XVII of FIG. 15.

Referring to the drawings and initially to FIGS. 1 to 8, there is illustrated a tackle practice apparatus according to the invention indicated generally by the reference numeral 1 for use in tackle practice, for example, during rugby practice training. The apparatus 1 comprises a dummy element 3 which is adapted to be tackled, and which is releaseably coupleable to a connecting means, namely, a ground engaging sled 4 so as to be detachable from the sled 4 on being tackled. A ligature, in this embodiment of the invention a rope 5 couples the sled 4 to a harness 6 which is adapted for releasable coupling to a motive means, in this embodiment of the invention a human person for pulling the sled 4, and in turn, the dummy element 3 across a playing pitch. A player wishing to practise tackling, tackles the dummy element 3 as it is being pulled across the playing pitch.

The dummy element 3 is an inflatable element of flexible plastics sheet material, and is shaped to be in the form of a representation of a human person, in a slightly bent knee posture. The size of the dummy element 3 is substantially similar to a typical rugby player. An elongated inflatable central bladder 7 extends upwardly through the dummy element 3 from an inflatable base element 9, which is described below, to form a relatively rigid central core 8 when the central bladder 7 is inflated with air in order to impart a reasonable degree of rigidity to the dummy element 3. A plurality, in this embodiment of the invention four abutting inflatable peripheral bladders, namely, two lower peripheral bladders 10 and two upper peripheral bladders 13 extend completely around the central bladder 7, thereby forming annuli. The lower and upper peripheral bladders 10 and 13 are inflatable with air through respective inflating ports 11 independently of each other and independently of the central bladder 7. An inflating port 12 is provided for inflating the central bladder 7 with air. The two lower peripheral bladders 10 are located below a waist high position 14 of the dummy element 3, and form a representation of a human subject from the waist downwardly. The two upper peripheral bladders 13 are located above the waist high position 14 of the dummy element 3, and the lower one of the two upper bladders 13 forms a representation of an upper torso of a human subject, while the upper one of the two upper peripheral bladders 13 form a representation of the head of a human subject.

The base element 9 comprises an inflatable first base bladder 15, and an inflatable second base bladder 16 located above the first base bladder 15, and from which the central bladder 7 extends upwardly. The second base bladder 16 is inflatable with air through an inflating port 18 independently of the central bladder 7 and the upper and lower peripheral bladders 10 and 13. The first base bladder 15 is adapted to be inflated with liquid, namely, water through an inflating port 20 to provide ballast to the dummy element 3 and to provide the dummy element 3 with a relatively low centre of gravity.

The sled 4 comprises a ground engaging inflatable ring 21 of a flexible plastics sheet material which is inflatable with air through an inflating port 22 and defines an annulus. A releasable coupling means which in this embodiment of the invention is provided by hooks 23 and eyes 24, of the type sold under the Trade Mark VELCRO releaseably couples the dummy element 3 to the inflatable ring 21, so that on being tackled the dummy element 3 immediately detaches from the inflatable ring 21. The hooks 23 are provided on an annular pad 25 which extends around the inflatable ring 21, and the eyes 24 are provided on an annular pad 26 which extends around the base bladder 15, see in particular FIG. 6.

A band 27 secured to the inflatable ring 21 is coupled to the rope 5, which in turn is coupled to the harness 6 for coupling the sled 4 to the person who is to pull the sled 4 with the dummy element 3 releaseably attached thereto. The harness 6 is provided by a belt 28 which is releaseably coupleable around the waist of the person.

In this embodiment of the invention the central bladder 7 is shaped so that a lower portion 29 of the central bladder 7 is of diameter greater than an upper portion 30. The two lower peripheral bladders 10 adjacent the lower portion 29 of the central bladder 7 are configured relative to the lower portion 29 of the central bladder 7 so that when the dummy element 3 is gripped by a person tackling the dummy element 3 around the two lower peripheral bladders 10 adjacent the lower portion 29 of the central bladder 7, a whistle 31 which is located in the inflating port 12 of the central bladder 7 is activated and acts as an indicating means to indicate that the dummy element 3 has been correctly tackled in the correct location, in other words, below the waist high position 14 of the dummy element 3. By providing the lower portion 29 of the central bladder 7 to be of diameter greater than the diameter of the upper portion 30, gripping of the dummy element 3 around the two adjacent lower peripheral bladders 10 is sufficient to increase the pressure of the air in the central bladder 7 to discharge a quantity of air from the central bladder 7 through the whistle 31 in order to sound the whistle 31. A high pressure relief valve 32 is located upstream of the whistle 31 within the upper portion 30 of the central bladder, and is set at a pressure to release air from the central bladder 7 to the whistle 31 for activation thereof in response to the dummy element 3 being correctly tackled around the lower peripheral bladders 10.

In use, with the tackle practice apparatus 1 attached to the human person who is to pull the tackle practice apparatus 1 by the harness 6, the tackle practice apparatus 1 is ready for use. The person with the harness 6 attached thereto commences to run across the playing pitch pulling the sled 4, and in turn, the dummy element 3 with the dummy element 3 extending upwardly from the sled 4 across the pitch. Another player who wishes to practice tackling then runs towards the dummy element 3 as it is being pulled across the playing pitch and tackles the dummy element 3. On the player engaging the dummy element 3, the dummy element 3 immediately detaches from the sled 4, thereby unaffecting the person pulling the sled 4. If the dummy element 3 is tackled around the two lower peripheral bladders 10 which are below the waist high position 14, and are adjacent the lower portion 29 of the central bladder 7, the whistle 31 is activated, thus giving an indication that the dummy element 3 has been correctly tackled.

Referring now to FIGS. 9 to 12, there is illustrated tackle practice apparatus according to another embodiment of the invention, indicated generally by the reference numeral 40. The tackle practice apparatus 40 is substantially similar to the tackle practice apparatus 1, and similar components are identified by the same reference numerals. The main different between the apparatus 40 and the apparatus 1 is in the construction of the central bladder 7 and an upper portion 42 of the dummy element 3. In this embodiment of the invention the central bladder 7 extends upwardly from the second base bladder 16 but terminates at the waist high position 14. The upper portion 42 of the dummy element 3 is formed by a single inflatable upper bladder 43 which forms a representation of the upper torso and head of a human subject. The upper bladder 43 is inflatable with air through an inflating port 44. Additionally, in this embodiment of the invention a pair of whistles 45 similar to the whistle 31 are located one in each of the inflating ports 11 of the lower peripheral bladders 10. The whistles 45 are activated by a correct tackle being made on the dummy element 3 around either or both of the two lower peripheral bladders 10. Otherwise the tackle practice apparatus 40 is similar to the tackle practice apparatus 1 and its use is likewise similar.

Referring now to FIGS. 13 and 14, there is illustrated a dummy element 50 of tackle practice apparatus according to another embodiment of the invention. The tackle practice apparatus 50 is substantially similar to the tackle practice apparatus 1 and 40 described with reference to FIGS. 1 to 8 and FIGS. 9 to 12, and similar components are identified by the same reference numerals. However, in this embodiment of the invention only the dummy element 50 is illustrated. The sledge 4 and the rope 5, as well as the harness 6 of the tackle practice apparatus according to this embodiment of the invention are similar to those of the tackle practice apparatus 1.

In this embodiment of the invention four lower independently inflatable lower peripheral bladders 10 are provided below the waist high position 14 extending completely around the central bladder 7. Each of the lower peripheral bladders 10 are provided with a corresponding whistle 31 which are similarly activated by the dummy element 50 being correctly tackled below the waist high position 14.

Additionally, in this embodiment of the invention the first base bladder 15 is provided with a transparent window 52 of plastics material which includes a graduated scale 54 to provide an indication of the weight of water in the first base bladder 15 so that the ballast weight provided by the water in the first base bladder 15 of the base element 9 can be immediately read from the scale 54. The central bladder 7 extends upwardly from the second base bladder 16 and terminates at the waist high position 14 in a similar manner as the central bladder 7 of the tackle practice apparatus 40 terminates at the waist high position 14 of the dummy element 3 thereof.

Pads 55 of a resilient material, typically, open or closed cell foamed plastics material, are attached on respective opposite sides of the dummy element 50. The pads 55 are located adjacent the waist high position 14 and adjacent a knee high position 56 on the dummy element 3. A pouch 57 is located on the front of the upper bladder 43 adjacent the front of the upper torso defined by the upper bladder 43 for holding a rugby ball 58.

Typically, the pads 55 will be of a harder and more rigid material than the inflatable bladders in order to give the effect of the more rigid bone structure of a person so that the dummy element more realistically represents a human person. It is envisaged that initially a player would use the tackle practice apparatus without the pads 55 being attached thereto, and as the player became more proficient in his or her tackling, the pads 55 would be added to the dummy element. It is also envisaged that pads of different levels of hardness and rigidity would be provided, and as the player became more proficient in tackling, the level of hardness and rigidity of the pads used would be progressively increased.

Otherwise, the dummy element 50 of this embodiment of the apparatus of the tackle practice apparatus is similar to the tackle practice apparatus 1 and 40 and its use is likewise similar to that of the tackle practice apparatus 1 and 40.

Referring now to FIGS. 15 to 17, there is illustrated a sled according to the invention, indicated generally by the reference numeral 70, for use in training a runner and/or a sprinter. The sled 70 comprises an inflatable ground engaging element 71 which is quite similar to the sled 4 of the tackle practice apparatus 1 described with reference to FIGS. 1 to 8. In this embodiment of the invention the ground engaging element 71 is in the shape of a torus and defines an annular hollow interior region 73, which is divided by a partition element 74 to form a lower first chamber 75 and an upper second chamber 76. The lower first chamber 75 is adapted for receiving a ballast medium, which in this embodiment of the invention is water, while the upper second chamber 76 is adapted to be inflated by air. The ground engaging element 71 as well as the partition element 74 are of a flexible plastics material, and the partition element 74 is sealably secured to the material of the ground engaging element 71 along its respective opposite side edges 77 and 78 so that the first and second chambers 75 and 76 are isolated from each other. A first port 79 is provided to the first chamber 75 for accommodating the ballast medium, namely, water into the first chamber 75 for inflating the first chamber 75 with the water. A second port 80 is provided to the second chamber 76 for accommodating air into the second chamber 76 for inflating thereof.

An indicating means for indicating the amount of ballast water in the first chamber 75 comprises an inspection window 81 of a flexible transparent plastics material which sealably closes an opening 82 in the material of the ground engaging element 71 to the first chamber 75. Graduations 84 on the window 81 form a gauge 83 to indicate the amount of ballast water in the first chamber 75. A band 85 extends around the ground engaging element 71 and couples a ligature, namely, a rope 86 to the ground engaging element 71. The rope 86 terminates in a harness 87 adapted for securing to the waist of a person who wishes to use the sled 70 for running and sprinting training. A clasp 88 on the harness 87 secures the harness 87 around the waist of the runner or sprinter.

In use, the first chamber 75 is charged with an appropriate amount of ballast water so that the ground engaging element 71 is of the desired weight. On completion of charging of the first chamber 75 with the ballast water, the second chamber 76 is inflated with air so that the entire hollow interior region 73 is inflated to a suitable pressure. The partition element 74 is of width between the opposite side edges 77 and 78 to facilitate variations in the volumes of the first and second chambers 75 and 76. During charging of the first chamber 75 with the ballast water, the amount of water in the first chamber 75 is determined from the graduations 84 on the window 81.

With the ground engaging element 71 charged with the ballast water and inflated by air to the desired pressure and of the desired weight, the harness 87 is then secured around the waist of the person wishing to train for running or sprinting, and the person then commences to run or sprint trailing the sled 70 behind the person with the ground engaging element 71 engaging the ground.

It is envisaged that during a training session, between each run or sprint, the volume, and in turn the weight of ballast water in the first chamber 75 of the ground engaging element may be progressively increased. It is also envisaged that the weight of ballast water in the first chamber 75 of the ground engaging element 71 may be progressively increased from one training session of a runner or sprinter to the next.

When the sled is not required, the ballast water is discharged from the first chamber 75 and the second chamber 76 is deflated. The ground engaging element 71 can then be folded away until it is next required.

While the dummy elements 3 have been described as comprising a central bladder and a plurality of peripheral bladder, while this is desirable, it is not essential. In certain cases, the dummy element may be provided with a central bladder and only one peripheral bladder extending around the central bladder, which typically, would extend the length of the central bladder. Indeed, in certain cases, it is envisaged that the dummy element may be provided in the form of a single bladder only. However, it is desirable that the centre of gravity of the dummy element should be as low as possible, and for this reason, it is desirable that a ballast means is provided in or adjacent a base of the dummy element. While the ballast means has been described as comprising an inflatable first base bladder adapted to be inflated with water, any other suitable ballast means may be provided.

Needless to say, any other suitable sled besides an inflatable sled may be provided.

While the tackle practice apparatus has been described as being suitable for pulling by a human person, it will be readily apparent to those skilled in the art that the tackle practice apparatus may be adapted to be pulled by any motive means, whether it be a human or a prime mover.

While the dummy elements have been described as being provided in the shape of a human person in a slightly bent knee posture, the dummy element may be in the shape of a human person standing erect, or in any other desired posture. Additionally, it is envisaged that while it is desirable to provide the dummy element in the shape of a human person, the dummy element may be provided of any other shape, and in certain cases, it is envisaged that the dummy element may be provided as a long cylindrical element.

While it is desirable that the sled should be inflatable, this is not essential.

It is also envisaged that instead of the first base bladder being adapted for inflating with water, the base element of the dummy element may be provided to be filled with sand, earth or any other suitable ballast material.

While the dummy element has been described as being coupled to the sled by VELCRO any other suitable coupling means may be provided. Indeed, in certain cases the weight provided by the ballast in the first base bladder of the dummy element may be sufficient to retain the dummy element on the sled without any other coupling means. It is also envisaged that the base element of the dummy element and the sled may be shaped so that the dummy element is releasably engageable with the base, and in which case it is envisaged that no other coupling means would be required to couple the dummy element to the sled.

While the sled 70 has been described with the ground engaging element 71 comprising first and second chambers 75 and 76, both of which are annular in shape, it is envisaged in certain cases that the sled 70 may be provided with a single chamber, although the advantage of providing the first and second chambers is that the second chamber can be inflated to accommodate different volumes of ballast water in the first chamber.

While the sleds have been described as comprising specific types of harnesses for attaching to the waist of a person, any other suitable harness may be used, and where the sled is adapted for coupling to a motive means other than a person, the harness would typically be appropriately adapted.

While the dummy element of FIGS. 13 and 14 has been described as comprising pads 55 of closed or open cell material, the pads 55 may be of any other suitable materials which would provide the appropriate degree of hardness and rigidity to simulate the hardness and rigidity of the bone structure of a human person.

While the tackle practice apparatus of FIGS. 13 and 14 has been described as comprising four pads 55, it is envisaged that any desired number of pads 55 may be provided, and the pads may be provided at any suitable or desired locations.

It is also envisaged that the sled of the tackle practice apparatus of FIGS. 1 to 14 may be replaced with the sled of FIGS. 15 to 17.

While the ground engaging element 71 has been described as being provided in the form of a torus, the ground engaging element may be of any other shape, for example, may be of circular plate or disc shape whereby the plate or disc would define a hollow interior region of substantially similar area in plan to the area of the plate of disc in plan, and the hollow interior region may also be divided into a first and second chamber, with the first chamber being below the second chamber.

The invention claimed is:

1. A tackle practice apparatus comprising:

a dummy element configured for being tackled; the dummy element comprising a weighted base element; wherein the weighted base element provide the dummy element with a relatively low center of gravity;

a ground engaging sled coupled to the dummy element by a releasable coupling; and means for pulling the tackle practice apparatus over a play area for simulating a player moving over the play area, wherein the means for pulling is connected to the ground engaging sled;

wherein while the tackle practice apparatus is being pulled, the dummy element disengages from the ground engaging sled when the dummy element of the tackle apparatus is tackled.

2. The apparatus according to claim 1, wherein the dummy element comprises an elongated element configured to extend in a generally upright orientation when in use.

3. The apparatus according to claim 1, wherein the dummy element is inflatable.

4. The apparatus according to claim 1, further comprising means for signalling, wherein the means for signalling is activated in response to a correct tackle.

5. The apparatus according to claim 4, wherein the means for signalling comprises a whistle which is activated by air being expelled in response to a correct tackle.

6. The apparatus according to claim 1, wherein the base element comprises an inflatable first bladder.

7. The apparatus according to claim 6, wherein the first bladder is inflated with a liquid.

8. The apparatus according to claim 6, wherein the base element comprises a second inflatable bladder located above the first base bladder.

9. The apparatus according to claim 8, wherein the second bladder is inflated with air.

10. The apparatus according to claim 1, wherein the releasable coupling comprises a hook and eye coupling.

11. The apparatus according to claim 1, wherein the ground engaging sled comprises an inflatable bladder.

12. The apparatus according to claim 11, wherein the inflatable bladder defines an annulus.

13. The apparatus according to claim 11, wherein the inflatable bladder is inflated with air.

14. The apparatus according to claim 1, further comprising a rope coupled to the ground engaging sled and extending therefrom for coupling the ground engaging sled to the means for pulling;

wherein the rope terminates in a harness for releasably coupling to the means for pulling.

15. The apparatus according to claim 14, wherein the harness is configured for releasably coupling to a person.

* * * * *